United States Patent [19]

Dodds

[11] 4,217,803

[45] Aug. 19, 1980

[54] PIANO-ACTION KEYBOARD

[75] Inventor: Philip V. W. Dodds, Needham, Mass.

[73] Assignee: ARP Instruments, Inc., Lexington, Mass.

[21] Appl. No.: 588

[22] Filed: Jan. 2, 1979

[51] Int. Cl.[2] ..... G10H 1/02

[52] U.S. Cl. ..... 84/1.1; 84/1.27; 84/DIG. 7; 200/277

[58] Field of Search ..... 84/1.04, 1.06, 1.09, 84/1.1, 1.14, 1.27, DIG. 7; 200/277

[56] References Cited

U.S. PATENT DOCUMENTS

| | | | |
|---|---|---|---|
| 3,480,744 | 11/1969 | Yamada | 84/1.27 X |
| 3,580,979 | 5/1971 | Amano | 84/1.1 |
| 3,835,235 | 9/1974 | Amano | 84/DIG. 7 |
| 3,845,683 | 11/1974 | Lehmann | 84/DIG. 7 |
| 3,943,812 | 3/1976 | Nagai et al. | 84/1.1 |
| 4,044,642 | 8/1977 | Pearlman et al. | 84/1.1 |
| 4,111,091 | 9/1978 | Hinago | 84/DIG. 7 |

*Primary Examiner*—S. J. Witkowski
*Attorney, Agent, or Firm*—Jerry Cohen

[57] ABSTRACT

A piano-action keyboard for an electronic musical instrument or the like wipes a switch actuator (or other mechanical component of electric signal translation means) across switch contacts on a printed circuit board to generate signals indicative of the position and motion of a key when played. The keyboard provides a highly realistic piano "feel" through an array of paired depressable playing keys and arms. Each such arm supports a switch actuator or the like, with varying force transmission at different stages of depression of its corresponding key, the overall electrical-mechanical combination affording a response in terms of both actual results and kinesthetic feedback simulating a manual piano action.

12 Claims, 10 Drawing Figures

REST

INITIAL DEPRESS

FURTHER DEPRESSION

PIANO-ACTION KEYBOARD

BACKGROUND OF THE INVENTION

This invention relates to a piano-action keyboards and, more particularly, to a piano-action keyboard for an electronic musical instrument and is characterized by uniquely providing realistic piano feel and practicality of high volume manufacture and utilization having regard to considerations of reliability, effectiveness and cost.

Musical instruments frequently use keyboards for determining sounds to be played. Two common kinds of keyboards are organ-type keyboards and piano-type keyboards. An organ-type keyboard has a plurality of two-state switches, each controlling a specified pitch. Each switch controls a tone source which generates a signal whose duration is determined by the length of time its corresponding key remains depressed. In contrast, a piano-action keyboard provides, in addition to pitch selection, a range of expression generally characterized by a complex function of volume, harmonic structure and envelope which is dependent on the speed and force with which the key is struck. At the same time, a characteristic kinesthetic feedback is provided. The "feel" of a keyboard is a characteristic that is generally of great importance to the player. Organ-type keyboards have a comparatively stiff, spongy feel, while piano-action keyboards typically have a lighter, more compliant feel. Commonly available electronic keyboard instruments typically have a feel more nearly characteristic of an organ, and this is a significant drawback when the instrument is used to simulate piano-type instruments, since the player is frequently conditioned by prior training to prefer the piano-action feel.

Conventional piano actions are quite complex in nature and their "feel" is determined by the interaction of a large number of moving parts. Careful adjustment of these actions is required during the manufacturing process and this adds to their cost. Further adjustments may be required during continued use, and this is an inconvenience, as well as a possible further expense, to the owner.

Accordingly, it is an important object of the present invention to provide an improved piano-action keyboard for an electronic music instrument, such as a polyphonic synthesizer, avoiding the difficulties of the above referred to prior art.

Further, it is an object of the invention to provide an improved piano-action keyboard that provides a realistic acoustic (traditional) piano-like output response and kinesthetic feedback to the player, consistent with the preceding object. Kinesthesia is the term encompassing the collective force and motion sensations experienced physically by the player.

A further object of the invention is to provide an improved piano-action keyboard that minimizes the number of mechanical components and/or which minimizes individual key adjustments as compared to a traditional piano-action keyboard, consistent with one or more of the preceeding objects.

A further object of the invention is to provide an improved piano-action keyboard which generates electrical signals indicative of the absolute position of a key and the force and speed with which a key is depressed consistent with one or more of the preceding objects.

A further object of the invention is to provide a piano-action keyboard which increases the resolution of position and velocity measurement consistent with one or more of the preceding objects.

A further object of the invention is to provide a piano-action keyboard for an electronic musical instrument which provides rapid restrike on partial release of a key consistent with one or more of the preceding objects.

A further object of the invention is to provide a piano-action keyboard which reduces uncontrolled bounce following key depressions consistent with one or more of the preceding objects.

SUMMARY OF THE INVENTION

In accordance with the present invention, a piano-action keyboard, usable for operation of electronic musical instruments (including pianos and in other contexts presenting equivalent needs in whole or in part), is formed from a linear array of depressable elongated playing keys, each pivotally mounted on a supporting base, and an array of elongated arms pivotally mounted on the base. Each arm has a forward end above and adjacent to a rear end of the key (keys and arms being arranged with substantially parallel elongation). In response to depression of a front end of any key to pivot it, the corresponding arm is moved by a force transmitted at an interface with the key. An electric signal means for the instrument includes fixed electrical circuit components behind the arms and compliant mechanical arms extending from the back of each arm to wipe across the fixed structure as the arm moves and thereby provide electrical signals indicative of the position of the key and velocity of key depression.

The said interface between key and arm of each pair is arranged to provide a varying geometric resolution of force transmitted from key to arm at different stages of key depression. At initial key depression, the component is lower and Fx component is higher compared respectively to Fy and Fx components at a later stage of key depression where y is direction of application of force (and of the arc path [tangent] of travel of the striking point between key and arm) and x is orthogonal to y. In short, the apparent resistance of the key arm combination to striking decreases at a later stage of key depression.

Each such arm has a weight distribution about its pivotal axis which acts in opposition to the force transmitted from a depressed key but continues inertial movement of the arm after key strike. Fixed stops intercept the heavily weighted arm portions. Restoring springs loaded by arm movement help return the arms to at-rest positions after key release and usually maintain key-arm contact. The spring force is overcome by the inertia of weight distribution to allow a sudden hard key strike to throw the arm into its extreme position beyond its key contact range (established by a key stop).

These and other objects, features and advantages of the invention will be apparent from the following detailed description with reference therein to the accompanying drawing in which:

BRIEF DESCRIPTION OF THE DRAWING

FIGS. 4A–3C are planar views of a number of alternative embodiments of the switchboard switch elements in which FIG. 4A shows a contact configuration in which two discrete pulses are generated as the switch actuator contacts either element.

DETAILED DESCRIPTION OF PREFERRED EMBODIMENTS

Figure 2:
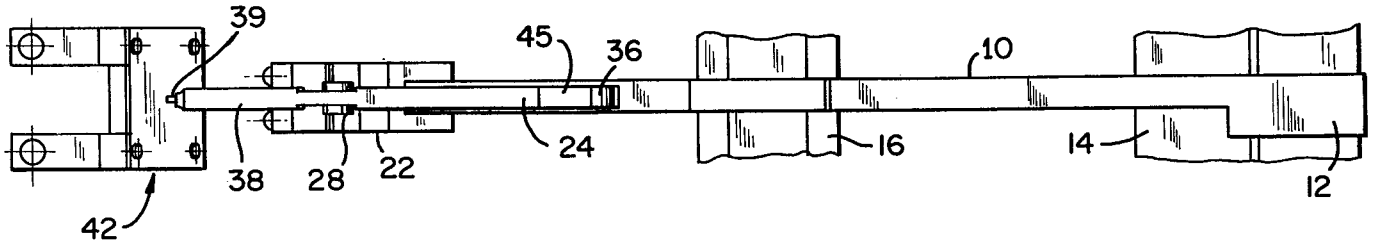
Figure 1:
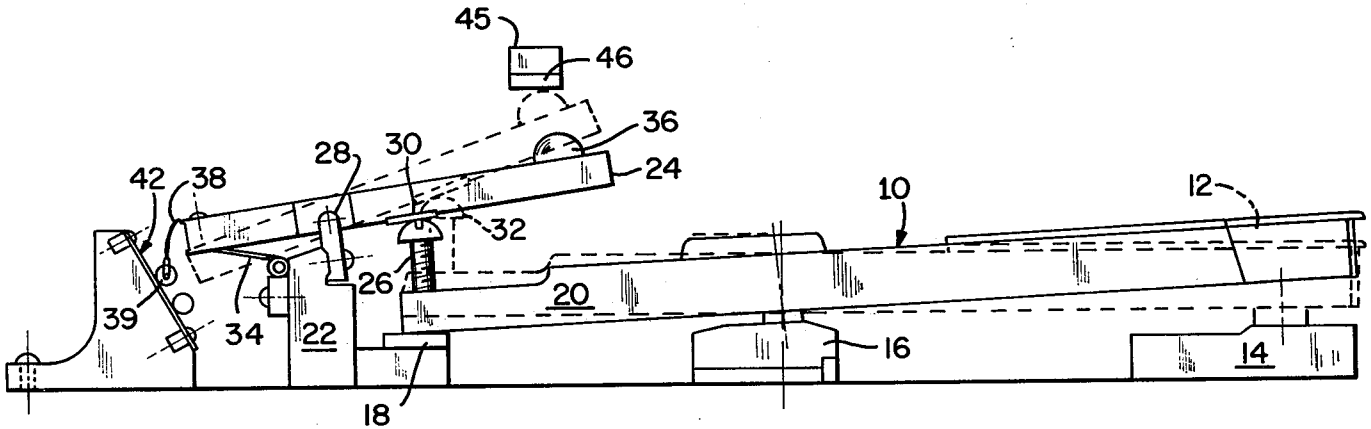
FIG. 1 is a side view of a single key arm/electrical signal output device combination of a keyboard and typical of all such combinations in the keyboard linear array and, FIG. 2 is a corresponding top view (a dash line alternate position is also seen)

Referring specifically now to FIGS. 1 and 2, an elongated key 10 having a playing end 12 and a front punching 14 is mounted thereunder is mounted for depression by a player. The key 10 rotates about a rail 16 and has a back cloth 18 mounted under a back end 20 of the key. Mounted adjacent the back end 20 of the key is the flange 22 supported from a fixed base and on which flange an arm 24 is mounted. A jack 26 may extend downward from the arm or upward from the key as shown (preferably the latter). The arm is pivotally mounted by means of a fixed pivot 28. A key pad 30 mounted on the rear end 20 of the arms meets the upper surface 32 of the jack 26. The flange 22 supports one end of a spring 34 which extends along the arm (rear) end remote from the flange 22. A spring arm 38 is mounted on the rear arm end, extends beyond the end of the hammer arm 24 and has a roller 39 mounted on its remote end. A switchboard 40 carrying an upper pressure sensitive layer 42 upon which the roller 39 presses is mounted on a lower frame 44. An upper frame 45 carries an arm stop 46 which limits the travel of the arm 24.

When the playing end 12 of the key 10 is depressed, the key pivots about the rail 16 and lifts jack 26 to thereby rotate the arm 24 about pivot 28. This causes the roller 39 to wipe downwardly across the switchboard in direct response to the motion of the arm 24. Although the weight 36 may contact the arm stop 46 at maximum travel, key travel is limited by the key contacting the front punching 14 when depressed.

Figure 3A:
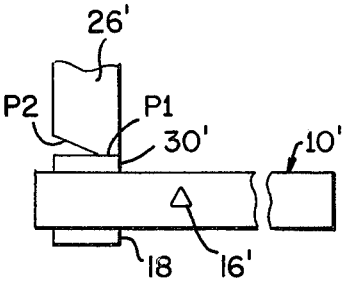
FIGS. 3A–3C are simplified force diagrams showing the general geometric resolution of forces transmitted from key to arm at two positions of the key and the nature of the key arm interface for another embodiment shown in FIG. 3D.
Figure 3B:
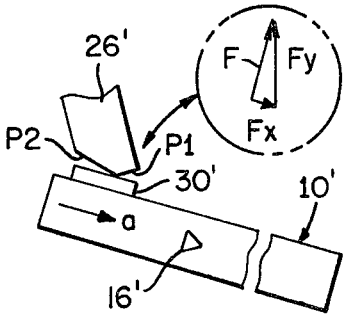
Figure 3C:
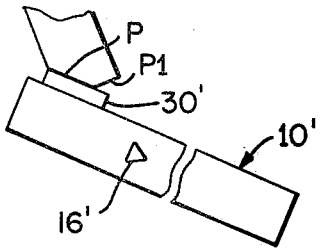
Figure 3D:
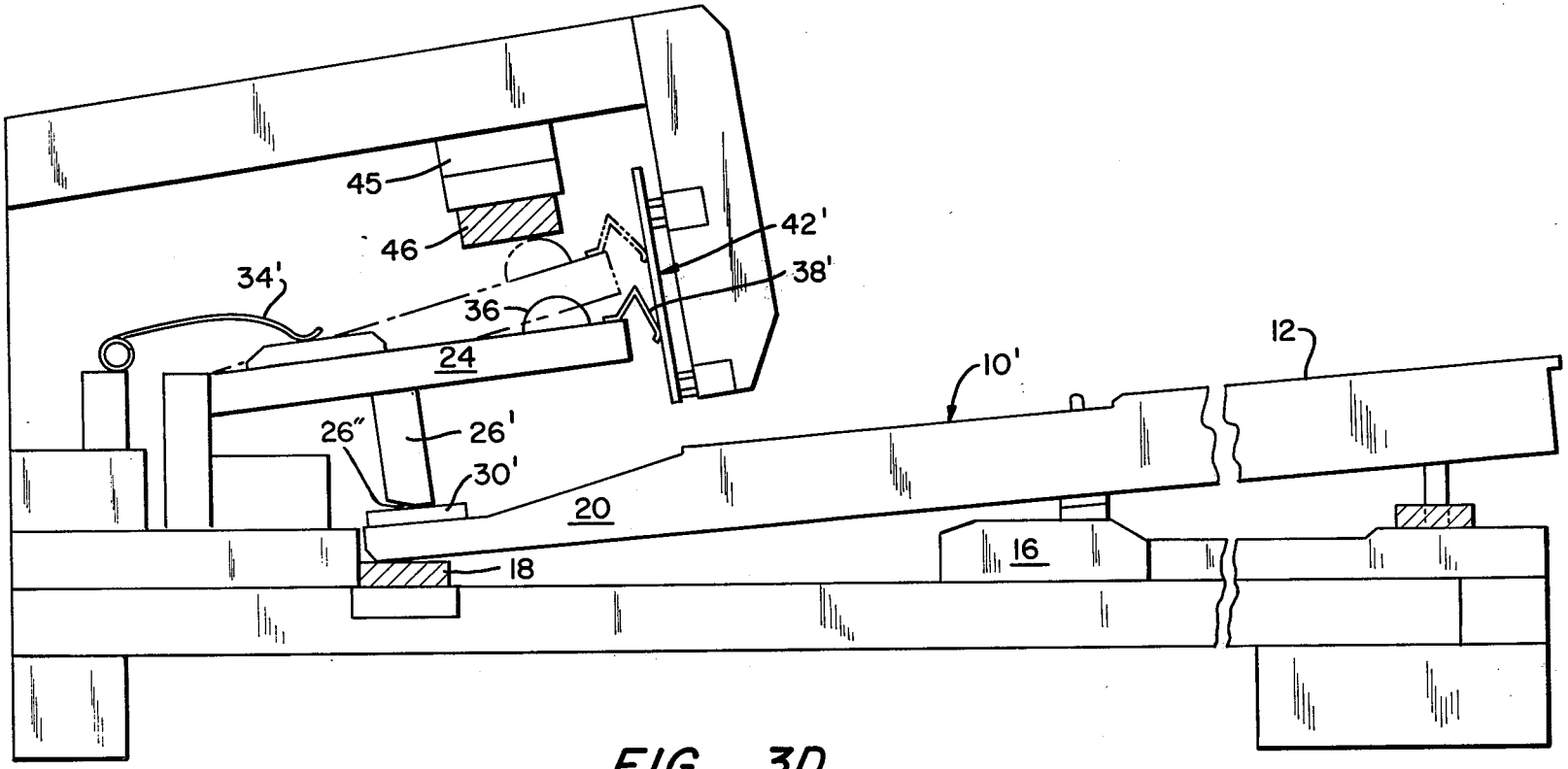

FIGS. 3A, 3B, 3C show resolution of forces for the FIG. 3D embodiment of the invention differing from that of FIG. 1 in that a jack 26′ extends from the arm to the key and meets it at an interface 26″. Two intersecting planes P1 and P2 of the jack end are engaged by a key pad 30′ on key 101. Plane P1 is engaged when the key is at rest (FIG. 3A). Initial depression (FIG. 3A through 3B positions) provides a resolution of transmitted force F into Fx and Fy components (where y is direction of movement of pad 30′ and x is orthogonal to y) that has a high Fx and low Fy compared to a later stage of key depression and resultant arm movement (FIG. 3B through 3C positions) where pad 30 engages plane P2 and Fx is much lower and Fy higher as resolved geometric components of transmitted force F.

Going back to FIG. 1, the same qualitative effects are achieved through the curved (spherically rounded) screw head end 32 of jack 26 on the key but with smoother transition from stage to stage.

As shown in FIG. 3A, the lower surface 32 of the jack 26′ comprises two intersecting planar faces P1 and P2. Initially, the jack face 50 rests flat on the key pad 30′. As the key is depressed, the remote end of the key rises off the backcloth 18 and the jack face 50 slides in direction "a" relative to the key pad. As the rear end of the key and the front end of the arm move upward, the orientation of the jack 26 rotates with respect to the key and the Fx component decreases. Upon release of a key, the inertial force of the weight 36 and the torsional force of the spring 34 pushing against the arm, act to restore the entire mechanism to its "rest" position as shown in FIG. 3A. The spring develops a relatively small, fast acting force overcoming the inherent limitations of an inertial force such as the arm weight. Through eliminating the escapement mechanism of a traditional piano action and through the increase in Fx as the key is released and the front end of the arm descends, contact can be maintained between the key and key bounce is reduced. This immediate restorative force adds responsiveness and quick restrike capability characteristic of a good piano action.

The added weight 36 (or an equivalent weight distribution within the arm) greatly contributes to the desired piano-action feel by providing an inertial force to the arm 24 which continues the motion of the arm in response to a brief but forceful key depression. This contributes to achieving the response of a grand piano action without the complexity of such an action. Control over wide dynamic range is provided by the above features.

Unlike a conventional piano action in which a hammer mechanism actually strikes a string to cause onset of a note, the piano-action keyboard for an electronic musical instrument need only impart a characteristic piano-action feed and response to the keys. Mechanically, this allows it to be greatly simplified, but electrically it must interface with circuitry which controls and generates the parameters necessary for operation of an electronic music instrument, (e.g., a synthesizer). This electromechanical interface is preferably provided by the switch elements. Any mechanical friction existent in the electromechanical interface will be "reflected" in the feel of the key action. Since it is an object of the present invention to provide a realistic key feel, and response, it is important that such friction be minimized.

One preferred form of the switch elements comprises a spring arm 38 and roller 39 mounted at the end of the arm remote from the pivoted end and a plurality of switch elements mounted on a switchboard 40 positioned tangential to the flight of the spring arm so as to remain in contact with the roller 39 through the entire arc which the arm 24 travels. The sliding friction which would normally exist if the spring arm 38 directly wiped the switchboard 40 is converted to rolling friction by roller 39. This roller reduces the overall drag that would otherwise exist in the keyboard response and substantially improves the restrike characteristics. Switch elements within the switch board 36 within this arc are utilized to implement a number of alternative embodiments for position and motion measurements.

Figure 4A:
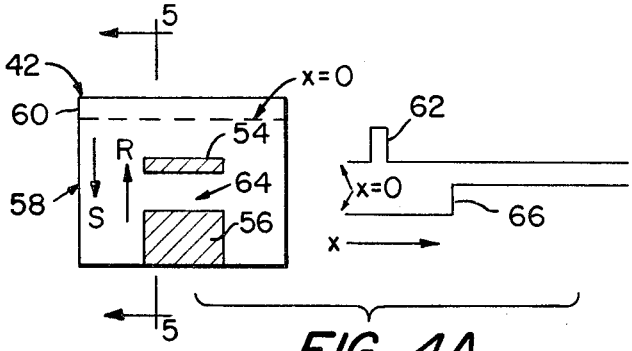
Figure 4B:
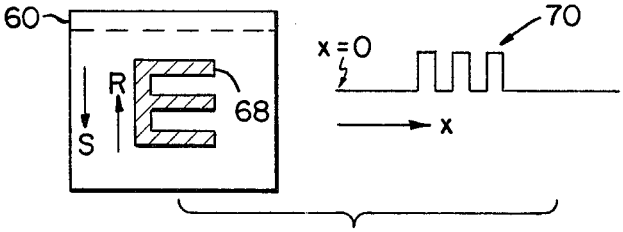
FIG. 4B shows a configuration in which a pulse train is generated on a single output line.
Figure 4C:
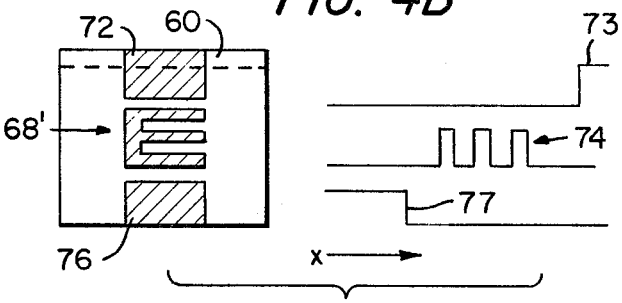
FIG. 4C shows a configuration having an added upper and lower contact.

FIGS. 4A–4C are planar views of various forms of contact boards useful in the invention. A preferred embodiment of the switch board contact elements is shown in FIG. 4A and comprises a narrow first contact 54 and a second contact 56 spaced from the first contact, both mounted on a substrate 58; the roller initially (i.e., at its rest position) contacts the PC board 58 at the position indicated by line 60. In its rest position, as the spring arm falls upon depression of a key, the roller crosses contact 54, developing an initial narrow pulse 62. It then passes across non-contact area 64 and finally touches contact 56 which develops a pulse 66 which remains "on" as long as the spring arm stays in the up position corresponding to the "key depressed" state. Arrows S and R indicate roller 39 motions on key strike and release. This configuration can provide significant information when interfaced with appropriate electronic circuitry. Since the first contact 54 is spaced below the rest position 60 of the spring arm, initial accelerations required to overcome gravity and mechanism friction have decreased by the time the spring arm crosses the first contact. The time between the falling edge of the first contact pulse 62 and the onset of the second contact pulse 66 is indicative of the velocity of key/spring arm travel. By attenuating initial irregularities in spring arm velocity, the measurement of this time becomes more repeatable for successive keystrokes. Partial release of a key brings the spring arm above the second contact thereby indicating key release. If the spring arm is allowed to at least touch the first contact area 54 before it again falls (due to key depression) to touch the second contact 56, the piano-action "restrike" characteristic is closely simulated.

An alternative contact scheme is shown in FIG. 4B. As the spring arm travels across the contact board 68, a series of pulses is generated. Iterative time measurements taken on this pulse then give "incremental," as well as average, velocity. FIG. 4C is a second pulse train contact layout utilizing two additonal contacts. An upper contact 72 remains "on" (73) until key depression begins. A pulse train 74 is then generated as described previously. A lower contact 76 then goes "on" (77) as the key reaches its maximum travel. Using this contact pattern, discrete events can be triggered at the beginning and end of key depression in addition to generating signals indicative of key velocity. For example, one of the intermediate pulses may be used to trigger a modifier, such as a sample-hold circuit for varying timbre. Also the final pulse, corresponding to the key being held down, can be used to control an "on-off" instrumental effect which is independent of key velocity. This can be useful in achieving a "layered" musical effect, with an "orchestral quality."

Since a plurality of algorithms exist for measurement of key strike velocity, it is important that an improved piano-action for an electronic musical instrument have an electro-mechanical interface flexible enough to meet the varying requirements of these different methods.

Figure 5:
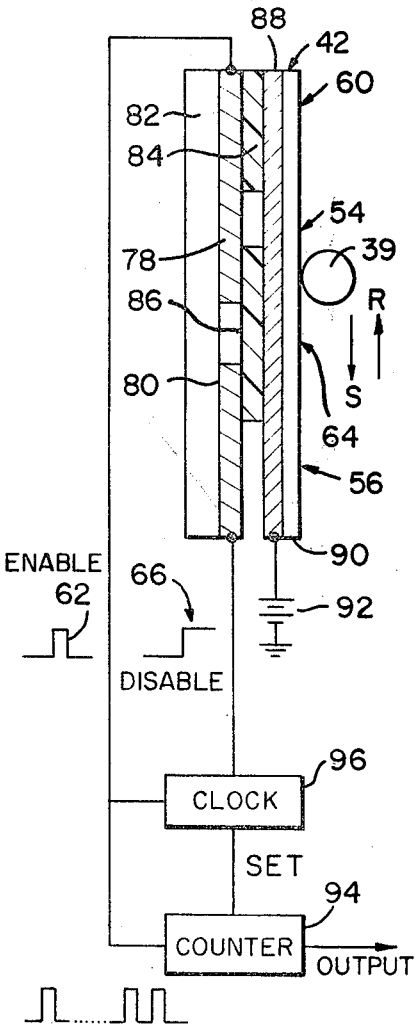
FIG. 5 shows a detail of the switchboard and a simple utilization circuit for measurement of arm's velocity.

The preferred embodiment of the "contact" previously described is a modified version of a commercially available "membrane" or "touch" type switch. FIG. 5 is a cross sectional elevation view of the switchboard of FIG. 4A. Two conductive pads 78 and 80 are mounted on an insulating substrate 82. Spacers 84, 86 are mounted to physically separate the conductive pads 78, 80 from the lower conductive surface 88 of the flexible switch plate 90. In operation, as the roller passes over area 54 the switch plate 90 flexes downward causing conductive layer 88 to contact pad 78, thereby creating a closed circuit. When the roller is over area 64, no contact is made due to the insulating spacer 86. Contact is made between the pad 80 and the conductive layer 88 when the roller depresses the switch plate 90 over area 56. A voltage source 92 is connected to the conductive layer 88 thereby generating voltage changes as the pads 78 and 80 are contacted.

An embodiment of utilization circuitry is also shown in FIG. 5. The positive-going edge of the pulse 62 resets a counter 94 to its maximum value. The negative-going edge of pulse 62 enables a high frequency clock 96 which begins decrementing the value in the counter. This decrementing continues until the positive-going edge of pulse 66 disables the clock thereby effectively "freezing" the final value in the counter. This final value is stored and used as a relative amplitude voltage to control an electronic musical instrument. The lower the velocity of key depression, the longer the time between first contact pulse and second contact pulse, and correspondingly, the smaller the final value output. Should the time between first and second pulses be long enough to allow complete decay from the maximum value, the output would be zero. This corresponds to a very slow key depression and, as in a true piano action, there exists a lower key strike threshold below which no sound is generated.

In an alternative optional embodiment, provision may be made to have some non-zero value of output corresponding to a very slow key depression. Although this is not characteristic of the response of a true piano action, it would be of considerable aid to musicians attempting to achieve an extremely soft "pianissmo" effect without the problem of some notes not sounding at all.

Variations from the above described preferred embodiments, meeting one or more of the objects of the invention and within the broadest scope thereof include, without limitation, capacitance or resistance change transducers in lieu of normally on or normally off switches; optical-mechanical pickups in lieu of electromechanical pickups; electromagnetic or magnetic pickups, or Hall effect pickups, in lieu of electromechanical pickups; multiple arms associated with each key (i.e., addition of intermediate arms between key and switch-carrying arm); and usage of the keyboards hereof in non-musical applications (e.g., graphics, computer or communication machine consoles).

Referring to the exemplary signal means shown in FIGS. 3D and 1-2 (the latter being preferred) it will be appreciated that various rolling or sliding arrangements can be made in various geometries to implement the objects of the invention.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. A piano-action keyboard for an electronic musical instrument comprising a plurality of elongated keys, a supporting base, each of said keys being pivotally mounted on said supporting base, a plurality of arms pivotally mounted on said base, each arm being adjacent one end of a key and arranged so that when the key is pivoted, a driving force is imparted to the adjacent arm by direct striking of the arm by the key at a strike point, electrical signal means comprising a mechanical component mounted on each said pivoted arm and plural portions of said signal means each of which is responsive to movement of one said arm to generate an electrical signal as the associated arm moves including response to rate of movement of the arm means defining an interface between each key and pivot-arm pair which varies the force resolution components of the force transmitted to the arm by key pivoting so that an initial stage of key pivoting from an at rest position produces lower Fy and higher Fx components where y is the direction of movement of the arm portion at the strike point and y is the orthogonal to x compared to Fx and Fy at a later stage of key depression.

2. A piano-action keyboard according to claim 1 in which said interface is defined by a face on one of the said arm and key at the region of striking therebetween comprising a curved surface configured to present a varying curvature to said key as said key is pivoted.

3. a piano-action keyboard according to claim 1 in which said interface is defined by two intersecting planar surfaces.

4. A piano-action keyboard according to claim 1 and further comprising in connection with each arm a spring means mounted on said base and applying a force on its said arm in opposition to the force applied to the arm by depression of its key, and means pivotally mounting the said arm, the said strike region and distribution of weight of each arm being arranged so that the weight distribution applies an inertial force (as an unbalanced net weight) on said arm in opposition to the force applied to the arm by the key.

5. A piano-action keyboard according to claim 4 which further comprises an upper frame extending over and above said pivoted arms, and arm stop means on said upper frame extending downward for contact by a heavily weighted portion of said arm at a limit of travel positon thereof.

6. A piano-action keyboard according to claim 5 in which said spring is so selected as to apply to said arm a force less than the inertial force of said weight distribution.

7. A piano-action keyboard according to claim 1 wherein the arms are aligned substantially parallel to their respective keys and all pivotally mounted in an array with forward ends of the arms overlying back ends of the keys, the keys being pivotally mounted at intermediate positions thereof, the said electrical signal means comprising an array of switches lined up behind the pivoted arms, each arm mounting on its back end, as said mechanical component of the signal means, a link which will act on one of said switches as the arm is removed in response to striking by the key, the range of motion of the pivoted arm including a portion where the arm remains in contact with its activating key and a portion where the arm can be out of contact with its activating key, the electrical signal means having distinctly different responses to movement of the pivoted arm in said different portions.

8. A piano-action keyboard for an electronic musical instrument comprising, a plurality of elongated keys, a supporting base, each of said keys being pivotally mounted on said supporting base, a plurality of hammer-like arms pivotally mounted on said base, each arm being adjacent one end of a key and arranged so that when the key is pivoted, a driving force is imparted to the adjacent arm by direct striking of the arm in a strike region thereof by the key, each arm having a heavily weighted portion relating to other portions thereof, electrical signal means comprising an actuating component mounted on each said pivoted-arm and plural portions of said signal means each of which is responsive to movement of one said arm to generate an electrical signal as the associated arm moves including response to rate of movement of the arm and to travel of the arm, a spring means mounted on said base and connected to each arm to apply to each such arm, when loaded by a corresponding key strike and resultant transmission of force to the arm, a restoring force in opposition to the force so applied, means pivotally mounting each such arm, the said strike region and distribution of weight of each arm being arranged so that the weight distribution applies an inertial force (as an unbalanced net weight) on said arm in opposition to the force applied to the arm by the key, the combination of spring and weight affording a kinesthetic feedback to the keys simulating that of a manual piano.

9. A piano-action keyboard according to claim 8 which further comprises, an upper frame extending over and above said pivoted arms, and pivoted arm stop means on said upper frame extending downward for contact by a heavily weighted portion of said arm at a limit of travel position thereof.

10. A piano-action keyboard according to claim 9 in which said spring is so selected as to apply to said arm a force less than the inertial force of said weight distribution.

11. A piano-action keyboard according to claim 8 wherein the arms, which all have similar arbitrarily designated forward and backward ends, are aligned substantially parallel to their respective keys, which all have similar arbitrarily designated forward and backward ends, and all said arms and keys pivotally mounted in respective arrays, with forward ends of the arms overlying back ends of the keys, the keys being pivotally mounted at intermediate positions thereof, the said electrical signal means comprising an array of switches lined up behind the said arms, each arm mounting on its back end, as said activating component of the signal means, a link which will act on one of said switches as the arm is removed in response to striking by the key, the range of motion of the said arm including a portion where the arm remains in contact with its activating key and a portion where the arm can be out of contact with its activating key, the electrical signal means having distinctly different responses to movement of the said arm in said different portions.

12. A piano action keyboard according to either of claims 1 or 8 wherein the signal means are constructed and arranged so that initial arm movement is ineffective to generate a signal, and subsequent movement is so effective, whereby the effect of initial accelerations of the key-arm mechanism output is attenuated.

* * * * *